US005699702A

United States Patent [19]

Myers

[11] Patent Number: 5,699,702

[45] Date of Patent: Dec. 23, 1997

[54] WRENCHING TOOL WITH FREE-FLOATING, SELF-RELIEVING ANTI-ROTATION KEY

[75] Inventor: Alan R. Myers, Quail Valley, Calif.

[73] Assignee: Fairchild Holding Corp., Chantilly, Va.

[21] Appl. No.: 695,782

[22] Filed: Aug. 1, 1996

[51] Int. Cl.[6] ..... B25B 21/00

[52] U.S. Cl. ..... 81/56; 81/57.14; 81/57.3

[58] Field of Search ..... 81/54.57, 57.11, 81/57.14, 57.3, 13

[56] References Cited

U.S. PATENT DOCUMENTS

| | | | |
|---|---|---|---|
| 2,882,773 | 4/1959 | Wing | 81/56 |
| 3,247,741 | 4/1966 | Batten | 81/56 |
| 4,538,483 | 9/1985 | Batten | 81/56 |
| 5,553,519 | 9/1996 | Petht, Jr. | 81/56 |

*Primary Examiner*—D. S. Meislin
*Attorney, Agent, or Firm*—Plante & Strauss

[57] ABSTRACT

There is disclosed an improvement in rotational wrenching tools used in the aerospace industry to apply a fastener nut to a fastener pin at a limiting, preload torsion. The pins used for the fasteners have an end recess which receives a rotational stationary key that is supported in the tool by a key holder which is slidably received in a central passage of the rotationally driven socket sleeve of the tool. This invention provides a first rotational detent at the forward end of the key holder and the central through passage and a first spring to bias the key holder axially forward into engagement with said first rotational detent to cause the key holder to rotate with the sleeve and thereby facilitate engagement and disengagement of the key with the fasteners. The invention also provides a second rotational detent at the rear end of the key holder and the housing to rotationally immobilize said key holder during run-up of the fastener nuts on the fastener pins.

7 Claims, 5 Drawing Sheets

WRENCHING TOOL WITH FREE-FLOATING, SELF-RELIEVING ANTI-ROTATION KEY

BACKGROUND OF THE INVENTION

1. Field of Invention

This invention relates to a wrenching tool for aerospace fasteners and, in particular, to a wrenching tool having a pin-immobilizing key secured in a key holder that facilitates engagement and disengagement of the key with the fastener pin.

2. Brief Statement of the Prior Art

A particular fastening system has been developed for use in the aerospace industry, which employs threaded pin fasteners and nuts having threaded collars and torsion limiting wrenching rings. In one type of fasteners (known commercially as the HiLok system) the wrenching ring is separated from the collar by a notched section which breaks when a predetermined limiting torque is exceeded. In another type of fastener (known commercially as the Eddie system), the wrenching collar has three lobes which deform when the predetermined limiting torque is exceeded. In both systems, the fastener is applied at a precise and predetermined tensile loading on the fastener pin.

Often, the threaded collar has an upset portion, usually a slightly elliptical shape, to provide a frictional spring lock that prevents the fastener nut from spinning off the bolt in the event that the residual tension on the fastener is lost.

The threaded fasteners are used both in loose and interference fit applications. In loose fit applications when it is difficult to work from both sides of the workpiece or when the fastener is applied by automated assembly, the drive tool is provided with a center key that seats into a broached recess in the end of the fastener pin to hold the pin stationary while the fastener nut is applied.

With composite aircraft construction which requires clearance holes and the application of sealants, stresses applied to the keys and recesses in the ends of the pins have increased dramatically. In these applications, the sealants lubricate the undersurface of the head of the pin during the initial tightening of the collar against the workpiece. Until the sealant extrudes sufficiently for the undersurface of the head of the pin to grab against the workpiece, the key must absorb the entire applied torque. Since the limiting, shear torque for the fasteners usually exceeds the shear strength of the pins, it is not uncommon for the keys to shear before the limiting stress on the nut fastener is reached, requiring the user to remove the wrenching tool, replace the key and attempt, again, to attach the fastener. Quick replacement of broken or jammed keys has become a necessity and prior U.S. Pat. Nos. 4,538,483 and 4,721,022 have addressed this problem by modification of the power tools to include a quick release key chuck, thereby minimizing down time required to replace keys.

Quick replacement of keys, however, is not a complete solution to the problem, particularly with automated assembly tools. Instead, the focus needs to be on facilitating the engagement and disengagement of the key with the fasteners, to avoid damaging the keys or jamming them in the fastener pins.

OBJECTIVES OF THE INVENTION

It is an objective of this invention to provide a powered wrenching tool which minimizes or prevents breakage of the keys used to immobilize fastener pins during their installation.

It is an additional objective of this invention to provide a powered wrenching tool with a key and key holder which facilitate engagement and disengagement of the key with fasteners.

It is also an objective of this invention to provide, a rotationally driven fastener tool which is suitable for use in an automated assembly of fasteners with composite materials.

It is likewise an objective of this invention to provide, in the aforesaid fastener tool, a rotational detent between the rotationally driven sleeve and the key holder of the tool, whereby the key holder can be driven in rotation with the sleeve during the engagement and disengagement of the key with fasteners.

It is additionally an objective of this invention to provide, in the aforesaid fastener tool, a second rotational detent between the key holder and the tool housing whereby the key holder is rotationally immobilized during the run up of the fastener nut.

Other and related objects will be apparent from the following description of the invention.

BRIEF DESCRIPTION OF THE INVENTION

This invention is applied to rotational wrenching tools used in the aerospace industry to apply a fastener nut to a fastener pin at a limiting, preset torsion. The pins used for the fasteners have an end recess which receives a rotational stationary key that is supported in the tool by a key holder which is slidably received in a central passage of the rotationally driven socket sleeve of the tool. This invention provides a first rotational detent at the forward end of the key holder and the central through passage and a first spring to bias the key holder axially forward into engagement with the first rotational detent to cause the key holder to rotate with the sleeve and thereby facilitate engagement and disengagement of the key with the fasteners. The invention also provides a second rotational detent at the rear end of the key holder and the housing to rotationally immobilize the key holder during run-up of the fastener nuts on the fastener pins.

BRIEF DESCRIPTION OF THE DRAWINGS

The invention will be described with reference to the figures of which.

DESCRIPTION OF PREFERRED EMBODIMENT

The invention comprises an improvement in the mounting of a rotationally stationary key in a key holder of a wrenching tool to provide a limited degree of resilient, rotational movement of the key.

The invention is particularly applicable to the otherwise conventional wrenching equipment used for the application of aerospace fasteners, and the invention will be described with reference to this application.

Figure 1:
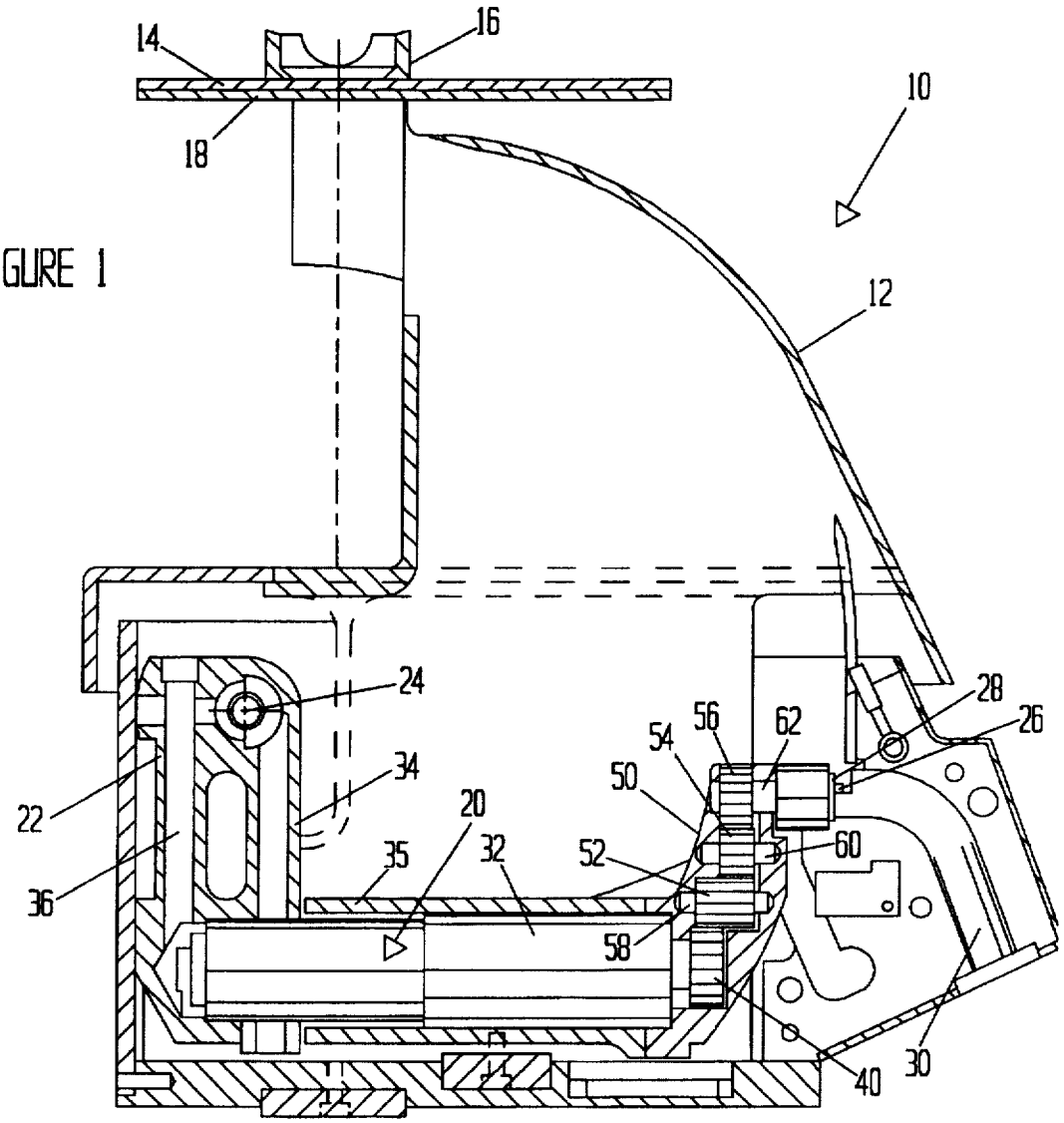
FIG. 1 is a side view of an installation tool for use with standard riveting tooling, showing the drive socket and key holder in their lowered position, during a drilling operation.

Referring to the FIG. 1, a fastener installation tool 20 is shown with an installation tool 10 such as used with conventional riveting machines used in the aerospace industry. Although not shown in the drawings, this tooling system includes an oil/air actuation system which can supply up to 500 psi with a 1:1 air/oil system, and greater pressures, up to 5000 psi with an air/oil booster. The tooling system also includes necessary control valves to operate the clamping device and the fastener installation tool.

The installation tool 10 has a clamp frame 12 which is mounted on the lower ram of a conventional riveting machine. The workpiece 14 (aircraft structure) is received between an upper pressure foot 16 and the upper foot 18 of the clamp frame 12. A fastener installation tool 20 is mounted on the clamp frame 12 by an L-shaped arm 22 that is pivotally mounted on a shaft 24 which is supported in the clamp frame 12.

In FIG. 1, the fastener installation tool 20 of the installation tool 10 is shown in its lowered position to accept a fastener nut 26 which is loaded into the drive socket 28 of the fastener tool 20. A vibratory feeder and vacuum pick up mechanism (not shown) deliver the fastener nuts, one at a time, to a delivery tube 30 which directs the nuts 26 to the socket 28.

The fastener tool 20 has a pneumatic drive motor within a motor housing 32 that is supported in the housing 34 of the drive arm 22. Compressed air for operation of the motor is supplied through a passageway 36 in the base leg 38 of the drive arm 22. The drive motor has an output gear 40 which is received in a gear head 50 that has a plurality of gears 52, 54 and 56 mounted on internal shafts 58, 60 and 62. The drive socket 28 is rotationally secured in the output gear 56, and the key holder for the immobilizing key (not shown) is slidably received within the drive socket 28. The conventional bearings and journals which support each of the gear shafts are not illustrated.

Figure 2:
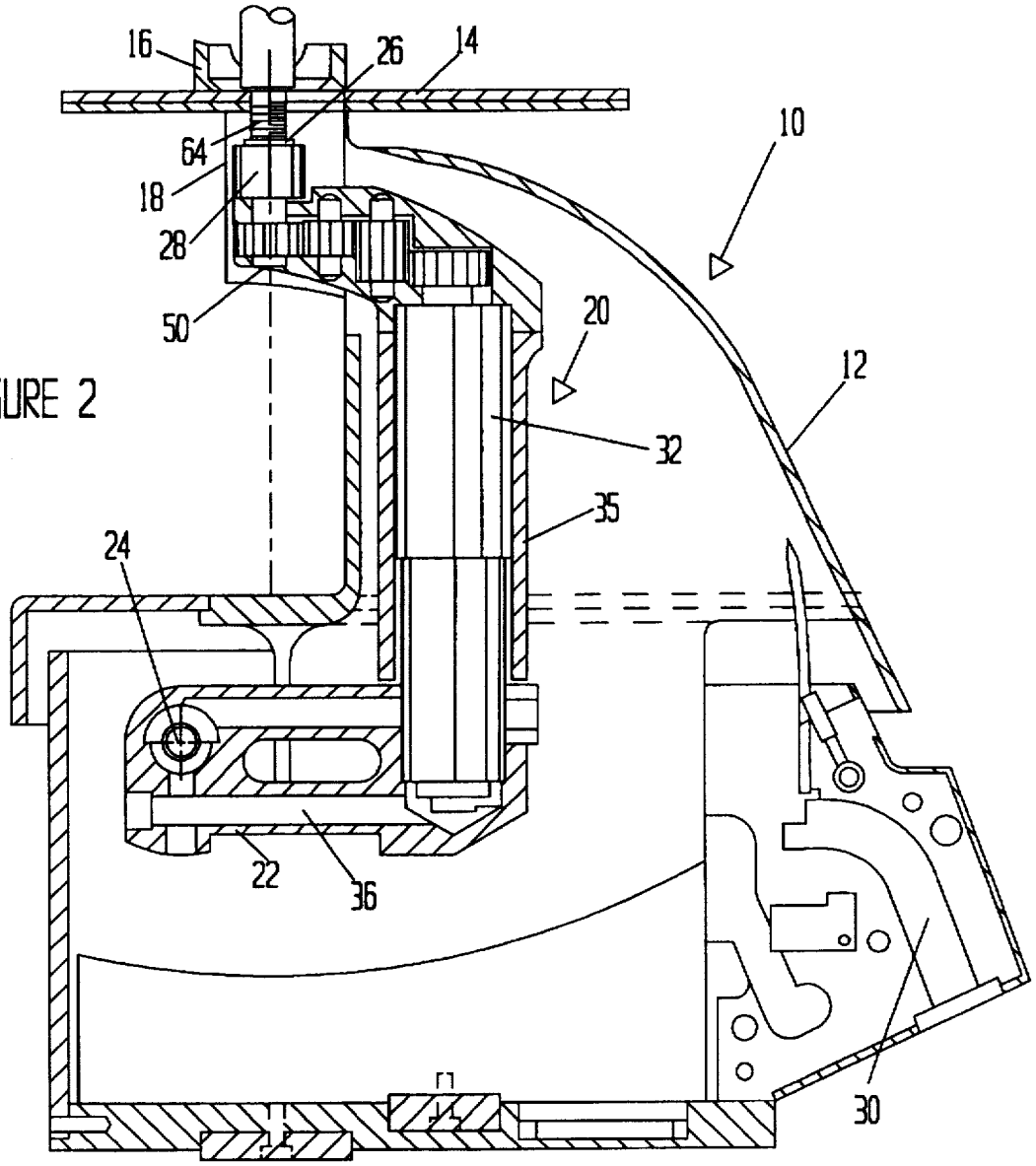
FIG. 2 is a side view of the installation tool for use with standard riveting tooling, showing the drive socket and key holder in their operative, elevated position for the application of an aerospace fastener.

The riveting machine is provided with a drill which automatically drills the clearance hole through the workpiece. Completion of the drilling operation causes the machine to move to its buck position, with the workpiece 14 clamped between the upper pressure foot 16 and the upper foot 18 of the clamp frame 12, as shown in FIG. 2. Sealant is automatically applied to the fastener pin 64 which is inserted into the hole drilled in the structure as the fastener installation tool 20 rotates into the position shown in FIG. 2.

FIG. 2 illustrates the socket 28 and key holder in the position for engagement of the key (not shown) in the pin recess and the nut 26 onto the pin 64. As described in greater detail with reference to FIG. 3, this invention provides a detent engagement of the key holder with the socket so that it is rotationally driven with the socket, and the end of the key readily seats in the recess at the end of the stationary pin. Once seated in the recess, the rotational detent between the key holder and socket is released, the key stops rotating, and the socket spins the nut onto the pin. As the nut is run down the fastener pin, the key holder moves into engagement with a stationary detent in the tool, and the socket continues to rotate until the preload is reached. This condition is shown in FIG. 4.

Figure 3:
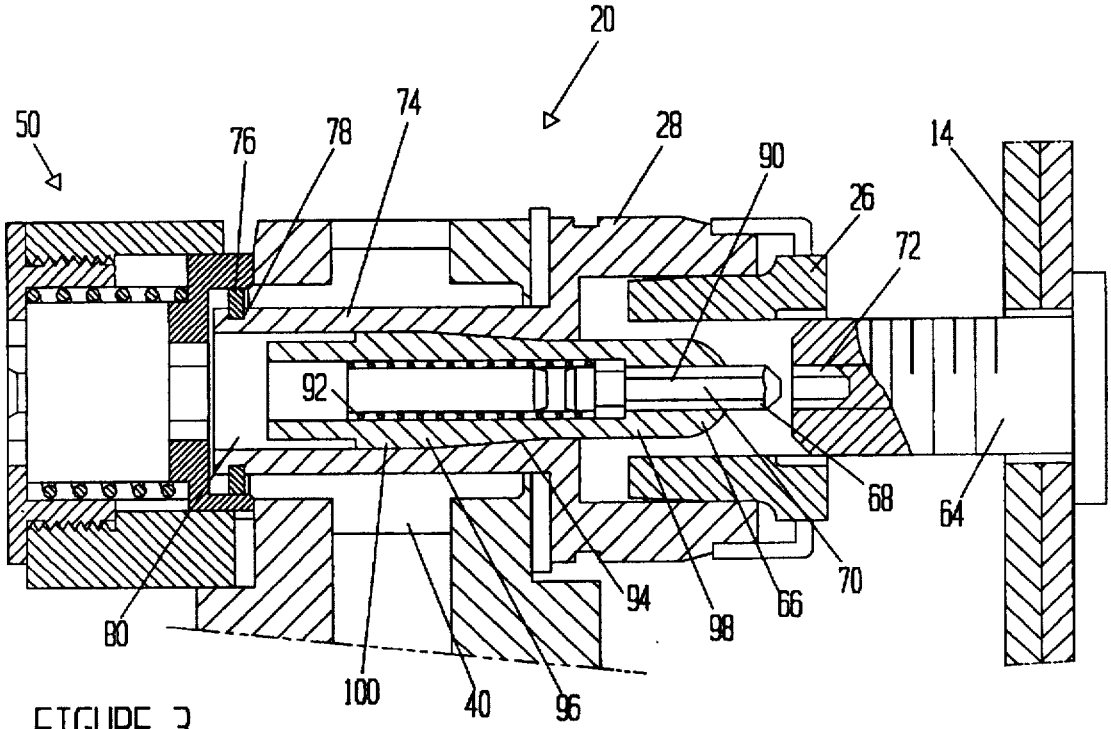
FIG. 3 is a sectional view of the drive socket and key holder during engagement of the key with the fastener pin.
Figure 4:
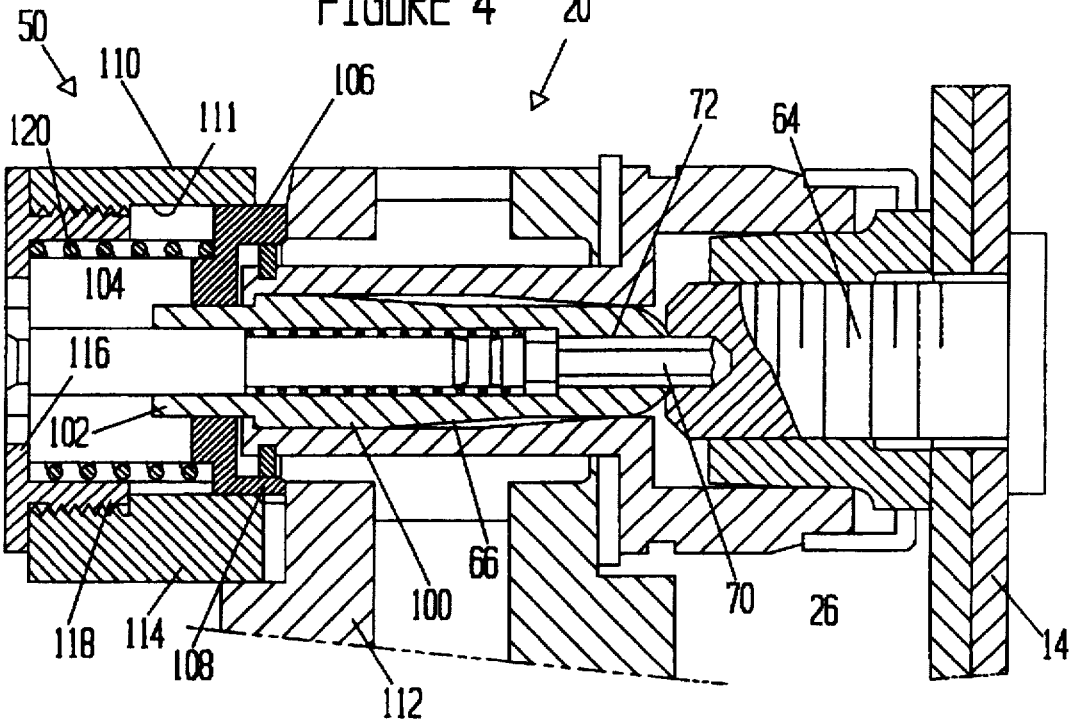
FIG. 4 is a sectional view of the drive socket and key holder during run-up of the fastener nut on the fastener pin.
Figure 6:
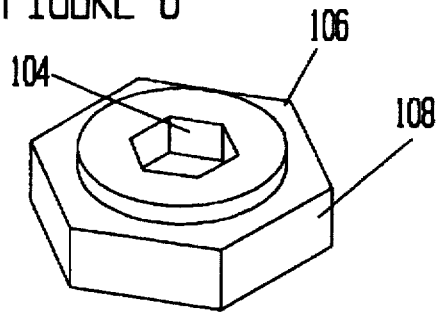
FIG. 6 is an exploded perspective view of the stationary detent used in the tool.

Referring now to FIG. 3, the socket 28 and key holder 66 are illustrated in their relative positions for engagement of the end 68 of the key 70 with the recess 72 in the end 68 of the fastener pin 64. The socket 28 has a hexagonal shaft 74 which is received in the output gear 40 so that the socket 28 rotates with the gear 40. The socket 28 is locked to the gear 40 by a ring 76 which is seated in an annular groove 78 on the outer periphery of the socket shaft 74. The key holder 66 is slidably received within a central passage 80 of the socket 28. The key 70 has a hexagonally flatted body and is seated in a mating central passageway 90 of the key holder 66, thereby being rotationally indexed to the key holder. The key holder 66 is slidably mounted in the passage 80 of the socket 28, and a compression spring 92 is supplied to resiliently extend the key holder in passage 80.

The fastener pin 64 is shown with the short key 70 about to engage the recess 72 at the end 68 of the pin 64, and the fastener nut 26 is shown within the socket 28, about to engage the threaded end of the pin 64.

The passage 80 has a locking taper 94 at its forward end. This taper has an included angle from about 2 to 7, preferably 4.5 degrees, and the key holder 66 has a mating tapered section 96 between its forward, reduced diameter end 98 and its inner, larger diameter end 100. The locking taper functions as a rotational detent between the key holder 66 and the socket 28, whereby the key holder 66 and key 70 are rotated with the socket 28, so that the end 68 of the key 70 will readily seat in the recess 72 of the fastener pin 64. As the key 70 seats in the recess 72, the key holder 66 retracts, disengaging the rotational detent between the tapers of the passage 80 and key holder 66.

Referring now to FIG. 4, the fastener installation tool 20 is shown in its position for application of the preload to the fastener. The key 70 is seated in the recess 72 at the end of the pin 64, and the fastener nut 26 is shown seated against the workpiece 14. The inner end 100 of the key holder 66 has a hexagonally flatted shaft 102 which is received in the central passage 104 of a disc 106 that is rotationally stationary in the assembly. The central passage 104 has hexagonal flats to mate with the flats on the end of the shaft 102. The disc 106 has an annular skirt 108 which also is hexagonally flatted. The disc 106 is received in a sleeve 110 which is fixedly secured to the housing 112 of the gear head 50. The sleeve 110 has a hexagonally flatted inner wall 111 thereby rotationally fixing the disc 106, while permitting a limited freedom of axial movement of the disc. The end 114 of the sleeve receives a cap 116 having a threaded boss 118 that engages internal threads in the end of the sleeve 110. A compression spring 120 is captured between the disc 106 and the cap 116 to resilient urge the disc 106 forward, into engagement with the end of the shaft 102 of the key holder 66.

Figure 5:
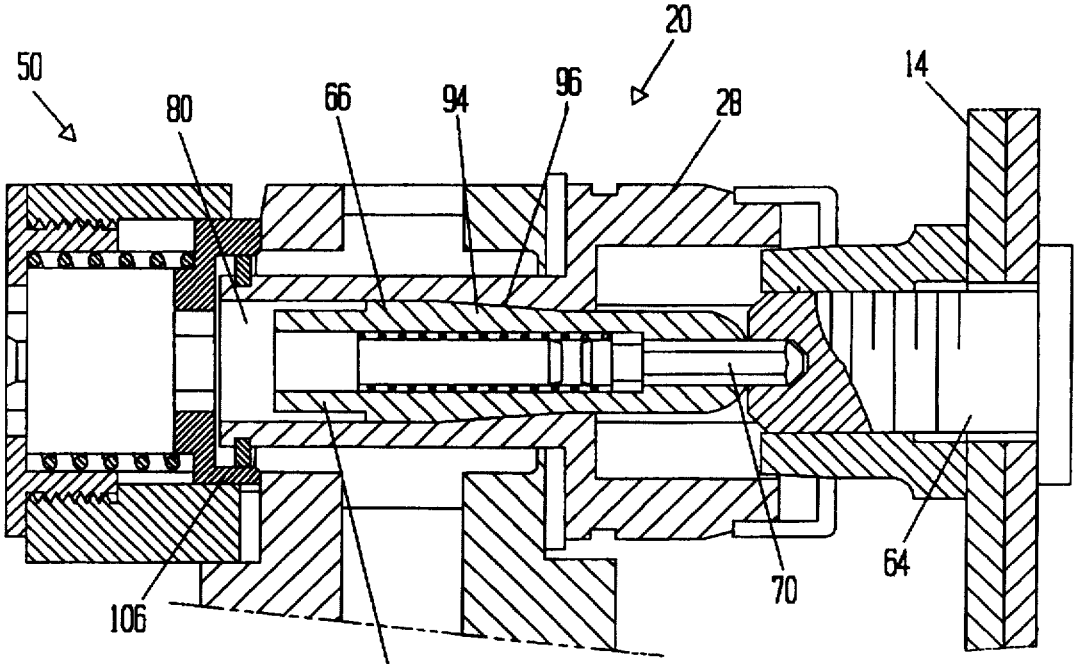
FIG. 5 is a sectional view of the drive socket and key holder during disengagement of the key from the fastener pin.

After the preload is reached, the socket 28 spins about the fastener nut 26 and the drive arm 22 is lowered. This causes the key holder 66 to extend from the position shown in FIG. 4 to that shown in FIG. 5, where the end of shaft 102 of the key holder 66 is disengaged from the disc 106, freeing the key holder 66 for rotation. As the drive arm 22 is lowered, the tapered section 96 of the key holder 66 moves into engagement with the locking internal taper 94 of the passage 80 in the socket 28 which serves as a rotational detent that applies a torquing action in a clockwise direction to the key holder 66, relieving any locking stresses between the key 70 and fastener pin 64 and permits facile retraction of the key 70 from the recess 72 in the end of the pin 64. The drive arm 22 then returns to the position shown in FIG. 1, to repeat the cycle.

The invention provides a rotational detent between the key holder and the socket whereby the key enters the recess in the end of the fastener pin before torque is applied, while the pin is stationary. The invention also provides the necessary rotational immobilization of the key holder during run up of the fastener nut and application of the preload. At the end of the cycle the driver continues to rotate as the tool is withdrawn, and the key holder is disengaged from the immobilizing detent, and is engaged by the rotational detent of the socket. This imparts a torque to the key which releases any strain in the key and insures that the key does not become jammed in the fastener pin.

The invention has been described with reference to the illustrated and presently preferred embodiment. It is not intended that the invention be unduly limited by this disclosure of the preferred embodiment. Instead, it is intended that the invention be defined by the means, and their obvious equivalents, set forth in the following

What is claimed is:

1. In a rotational wrenching tool for applying a fastener nut to a fastener pin having an end recess, said tool having a housing supporting a rotationally driven sleeve with a distal socket to receive said fastener nut, and a central through passage in which is axially slidably received a key holder, and a key removably seated in said key holder, said key having an outer end which is to be positioned in said end recess of said fastener pin for rotationally immobilizing said fastener pin, the improvement comprising:

a. a first rotational detent at the forward end of said key holder and said central through passage to rotationally index said key holder to said sleeve and including a first spring to bias said holder axially forward into engagement with said first rotational detent; and b. a second rotational detent at the rear end of said key holder and said housing to rotationally immobilize said key holder;

whereby said key holder is driven in rotation with said sleeve until said key is seated in said end recess of said fastener pin, is rotationally immobilized during the run up of said fastener nut and is rotationally driven after application of said fastener nut to free said key and permit removal of said tool from the applied fastener.

2. The rotational wrenching tool of claim 1 wherein said first rotational detent comprises a conically tapered forward end of said key holder and a mating conically beveled portion of said through passageway.

3. The rotational wrenching tool of claim 1 wherein said conical taper has an angle from 3 to about 5 degrees to its longitudinal axis.

4. The rotational wrenching tool of claim 1 wherein the rear end of said key holder has at least one flat and including a disc non-rotationally secured to said housing having a flatted aperture to receive the rear end of said key holder.

5. The rotational wrenching tool of claim 4 wherein said rear end of said key holder and said flatted aperture are hexagonally flatted.

6. The rotational wrenching tool of claim 1 wherein said disc is slidably received in said housing along the axis of said key holder and including a second spring to bias said disc towards said key holder.

7. The rotational wrenching tool of claim 1 wherein said fastener pin has a hexagonally flatted end recess and said key has a mating hexagonally flatted end.

* * * * *